United States Patent [19]

Serres et al.

[11] Patent Number: 4,549,170

[45] Date of Patent: Oct. 22, 1985

[54] SYSTEM FOR MANAGING A PANEL OF OBJECTS SUCH AS KEYS

[76] Inventors: Bernard M. Serres, 7, rue des Pommaries, 74000 Annecy le Vieux; Joël R. Doucet, 15, rue Roger Salengro, 92130 Issy-les-Moulineaux, both of France

[21] Appl. No.: 493,380

[22] Filed: May 10, 1983

[30] Foreign Application Priority Data

May 17, 1982 [FR] France ..... 82 08569

[51] Int. Cl.[4] ..... G08B 13/14

[52] U.S. Cl. ..... 340/568; 340/518; 340/525

[58] Field of Search ..... 340/525, 568, 518, 521

[56] References Cited

U.S. PATENT DOCUMENTS 3,251,049 5/1966 Hallerberg ..... 340/525
3,908,800 9/1975 Drapeau ..... 186/1 R
4,060,795 11/1977 Harumiya ..... 340/518 X
4,205,328 5/1980 Gotanda ..... 340/521
4,262,286 4/1981 Tanigawa ..... 340/600 X

OTHER PUBLICATIONS

Article by H. C. Normann, Published in "IBM Technical Disclosure Bulletin", vol. 21, No. 1, Jun. 1978, p. 299.

*Primary Examiner*—James L. Rowland
*Assistant Examiner*—Jeffery A. Hofsass
*Attorney, Agent, or Firm*—Lowe, King, Price & Becker

[57] ABSTRACT

Each object on a panel has a respective location designated by an address and associated with an indicator lamp. A panel managing system comprises a memory for successively reading location address combinations. The indicator lamps are successively energized at the locations designated by the addresses read from one and the same combination so that a collector withdraws or inserts the objects at designated locations. The objects are detected to check the normal presence or absence of the objects in the panel after withdrawal or insertion of each object.

28 Claims, 3 Drawing Figures

SYSTEM FOR MANAGING A PANEL OF OBJECTS SUCH AS KEYS

BACKGROUND OF THE INVENTION

1. Field of the Invention

This invention relates to a system for managing a panel of objects such as keys.

In a great many fields of activity, a large number of keys must be handled. This is so particularly for collecting the interchangeable and removable coin boxes from a network of service vending machines, for telephone calls (public telephone sets), parking durations (parking meters) or games (pin-ball machines), or item vending machines for photocopies, transport tickets or confectionary items.

2. Description of the Prior Art

The task of collecting the coin-boxes is split into rounds, each ascribed to a collector. The collection rounds are established in terms of various parameters which cover especially:

- number and geographical spread of the vending machines;
- rapidity with which the coin boxes are filled;
- time required to withdraw each coin box filled with receipts and replacing the filled box with an empty coin box in an access compartment locked by key and designed therefor in the vending machine;
- safety of the receipts collected particularly when transporting the coin-boxes between the vending machines and the coin-box management center.

These various parameters are mutually independent and give rise to collection rounds that differ from one day to the next and to the fact that each collection round must not be carried out by the same person two days running at least.

The outcome of these considerations is the problem of managing the keys in the coin-box access compartments of the vending machines. Great care must be taken every day to put the keys back in place in readiness for use the following day in a strict order when composing the bunches of keys issued to each collector entrusted with a collection round. The allocation of keys to the rounds and hence to the collectors must give no cause for error so that a "fraudulent" collector may be unmasked should the receipts collected in a coin-box turn out to be abnormally low for example.

At the current time, use is quite simply made of a straightforward wall-mounted key panel sporting nails or hook from each of which a key is hung. Labels carrying the key numbers corresponding to the numbers of the vending machines are affixed to the panel above the nails. On other known panels, the nails are replaced by compartments inside each of which a key is to be placed. When making up a bunch of keys, an operator in the management center reads the key numbers for each bunch so that the collector may successfully pick out the keys. To ease key selection, the space between the nails or compartments must be large; as a result, the dimensions of the panel are very large, thereby making it difficult for the operator to run a quick and accurate check of the taken keys.

In a further known embodiment of a key panel divulged in U.S. Pat. No. 4,205,328, each nail is replaced by an opening through which is passed a holding member from which the respective key hangs. The holding number is caught by gravity in the opening to activate a reed switch via a permanent magnet rod attached to the holding member. A lamp is activated by the reed switch closing in response to the presence of the permanent magnet to indicate that the key is hanging on the panel.

Moreover, systems are known that aid in managing items, pharmaceutical products for example, for dispensing purposes.

U.S. Pat. No. 3,908,800 describes a system for selecting items to be distributed throughout the cubby holes of a stock cart. A computer and a memory are provided to read data sequences, such as the location of cubby holes, thereby turning on light distribution indicators which show the operator the specific item quantities to be picked in the cubby holes. However, after having withdrawn items from a given cubby hole, the operator must press an "Index" button which causes the information for the next cubby hole to be indicated.

The article by H. C. NOMANN titled "AUTOMATIC COMPUTER INPUT OF INVENTORY COUNTS" published in IBM Technical Disclosure Bulletin, Vol. 21, No. 1, page 299, June 1978, New York, describes an assemblage of force sensors to measure the weight in each of a series of bins. The sensors are each assigned to a bin or tray and are linked to an inventory control system making it possible to monitor and record the weight of the items placed in each bin. The control system only provides information as to whether or not there are items in the bins.

OBJECTS OF THE INVENTION

A main object of this invention is to provide an object management system and an associated panel for verifying the abnormal presence or absence of objects in a panel as each predetermined combination of objects, such as a bunch of keys for a round, is composed.

Another object of this invention is to compose a combination of objects on an on-going basis by successive automatic indications to apprise a collector that he should withdraw or put back the objects in the respective locations without the slightest error.

SUMMARY OF THE INVENTION

The present invention provides a system for managing an object panel on which each object has a respective location, such as a recess or a removable receptacle; each location is designated by an address and is associated with a display means such as an indicator lamp. The successive energization of the indicator lamps on the front of the panel at the object locations eases the visual recogniation of the objects as to withdrawal or insertion, thereby obviating any error in constituting the combinations of objects.

The object managing system comprises means for storing predetermined combinations of location addresses, means for successively reading the stored combinations, means for successively energizing the display means at locations designated by the read addresses having the same combinations as the stored combinations detect whether the objects at the locations are withdrawn or inserted, and means for detecting objects to check the withdrawal or insertion of the withdrawn or inserted objects in the panel. The display means at a location designated by a read address of a combination is energized and the display means at the location designated by the address previously read in said combination is deenergized in response to detection of the withdrawal or insertion of the object at said location designed by said previous address.

The above means of the managing system are structured around a microprocessor with conventional peripherals such as a keyboard, thus enabling dissociation of the operations for organizing the rounds, carried out the previous day, for example, and the composition of the combination of objects, such as bunches of keys.

To avoid any error in opposing keys on the panel, as often happens on a panel with nails or cubby holes, the panel embodying the invention comprises at each location a receptacle having an opening with an outline substantially identical to a predetermined portion of the respective object; for a key, the receptacle is analogous with a dummy lock.

Advantageously, the states of the object presence or absence detecting means are automatically checked following each normal withdrawal of an object when making up a combination of objects, or following each normal insertion of an object when returning the objects after the rounds. The check enables detection of whether one or more objects have been abnormally withdrawn from the panel by the collector. In this case, alarm means in conjunction with display means apprises the operator of the locations where the objects have been abnormally withdrawn.

BRIEF DESCRIPTION OF THE DRAWING

Other features, advantages and objects of this invention will be more clearly apparent from the following description of preferred embodiments of the invention as illustrated in the accompanying corresponding drawing in which.

DESCRIPTION OF THE PREFERRED EMBODIMENTS

Figure 2:
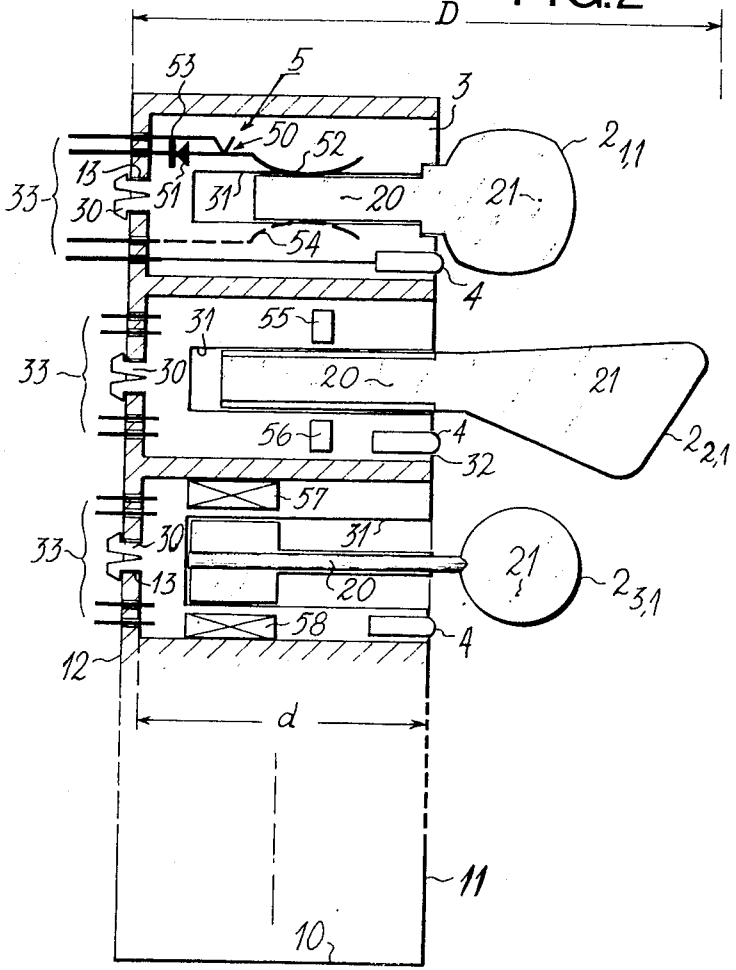
FIG. 2 is an enlarged cross-sectional view, taken along a a portion of a column in the panel, of details of three different removable key receptacles or modules having key presence or absence detecting means of the present invention.
Figure 1:
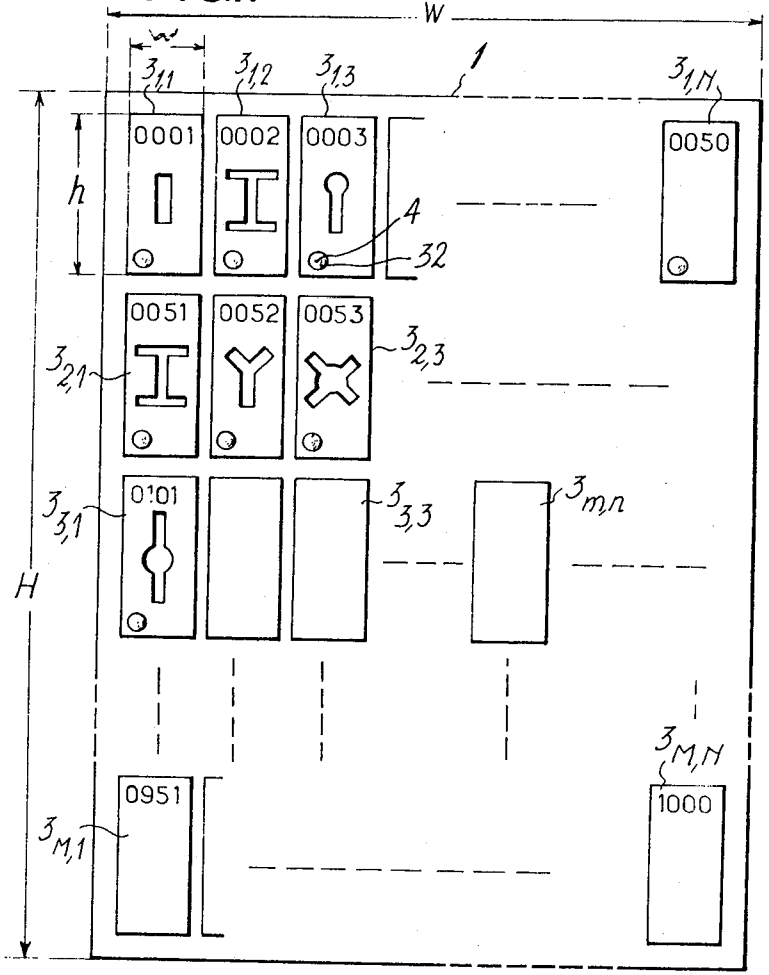
FIG. 1 is a fragmentary front view of a panel for one thousand keys used in the present invention.

Referring to FIGS. 1 and 2, panel 1 is designed for receiving M×N objects such as various keys $2_{11}$ to $2_{M,N}$. The product M×N is assumed to be equal to 1000 hereinafter.

The panel 1 is primarily made up of a hollow parallelepipedal base 10 having an open front face 11 and a back face 12 secured agains a wall, or preferably located in a safe locked by key. The base 10 offers M×N locations $3_{11}$ to $3_{M,N}$, each assigned to a respective key $2_{11}$ to $2_{M,N}$. The M×N locations $3_{11}$ to $3_{M,N}$ are set out in matrix form comprising M=20 horizontal rows each having N=50 aligned locations so each location is a vertical column.

Each location $3_{m,n}$, where m in each integer between 1 and M and n in each integer between 1 and N, assigned to respective key $2_{m,n}$, is in the form of a parallelepipedal recess containing a removable module housed. As shown in FIG. 2, the bottom of a module 3 carries two small rearwardly extending protrusions 30 shaped as opposed flexible. hooks, which penetrate a hole 13 in the back face 12 of the panel base to secure the module 13 simply by push-fit to the back face 12. The modules can be separate individual members, especialy when the keys are all different, but can constitute removable molded monobloc assemblages; each assemblage comprising for instance one or more adjacent rows or columns of modules, particularly when the keys for each monobloc assemblage are identical.

In the panel with one thousand keys, the width w, the height h and the depth d of a recess or module 3 are respectively equal to 12 mm, 27 mm and 46 mm and the width W, the height H and the depth D of the base 10 are respectively equal to 80 cm, 60 cm and 10 cm.

The front face of each module 3 for receiving a key is substantially coplanar with the front face 11 of the base 10 and includes a central opening 31. The outline of opening 31 is identical to the overall cross-section of a predetermined portion, such as the bit 20, of the respective key 2. When the bit 20 of key 2 is inserted into the respective module 3, the head 21 of key 2 butts against the front face of the module; alternatively the tip of the bit 20 of key 2 butts agains the bottom of the module. The module may thus be likened to a dummy lock as depicted in FIG. 2. In FIG. 1, a few outlines of openings 31 and key bits 20 are shown as being rectangular, I shaped, Y shaped and cross shaped.

The front face of each module 3 for a key 2 further comprises a hole 32 in which is lodged the tip of a display means, such as a light emitting diode 4 that is energized to signal the collector that he can withdraw or insert the key 2.

As depicted in FIG. 2, each module 3 encloses means 5 for detecting the key with a view to indicating and checking the presence or absence of the respective key 2 in the module 3. Three embodiments of the key detecting means are shown in FIG. 2.

A first embodiment of key detecting means shown at the top of FIG. 2 is composed of an opening contact having two reeds 52 and 53 polarized by a series-connected diodes 51. The tip of one reed 52 of the contact 50 is curved to provide a large radius bend against which the bit 20 of the key 2 slides when the bit is inserted through the opening 31, thereby pushing the curved reed 52 against the other reed 53 to close the contact 50. If necessary, a spring, such as another curved reed 54, is arranged symmetrically opposite the reed 52 to press against the other side of the bit 20 and act as a guide for the bit and provide sufficient pressure for the reed 52 against the reed 53 of the contact 50.

A second embodiment of key detecting means shown in the second module from the top in FIG. 2, includes a photocoupler having a photoemissive member 55 and a photoreceptive member 56 arranged on either side of the bit 20 of the key 2 in the module recess. The photoemissive member 55 is typically a small lamp, a light-emitting diode or a photoemissive diode. The photoreceptive member 56 is typically a photodiode or a phototransistor. Preferably, the photoemissive member 55 emits in the infrared waveband any to obviate any parasitic detection of visible light that may enter module 3 through the opening 31 in particular; in this case, the photoreceptive member is a charge coupled device CCD.

The photoemissive member 55 is permanently connected to an electric source. The photoreceptive member 56 is screened when the key is inserted; however when the key is withdrawn the screen is removed to activate the photoreceptive member, causing it to produce a current flow which indicates the absence of the key in the module. In a further embodiment, the individual photoemissive member 55 is replaced by a single photoemissive member that is common to all the recesses and located, for example, on the internal surface of the back face 12 of the base 10. The intensity of the single photoemissive member is relatively high to radiate across suitable holes in the recesses in the modules 3 to activate the photoreceptive members opposite the holes.

The third embodiment of key detecting means shown at the bottom in FIG. 2 is an electromagnetic coupler. This coupler comprises a so-called emitting coil 57 and a so-called receiving coil 58 arranged on opposite sides of the key bit 20 in the module recess. Coils 57 and 58 have axes aligned perpendicularly to the key bit 20. The emitting coil 57 is permanently connected to an electric power supply. No current flows in receiving coil 58 while the key 2 is present in the module 3; when the key 2 is absent from the module 3, a current is induced in coil 58 by the magnetic flux emitted by the other coil 57.

According to a fourth embodiment, not shown, the key detecting means comprises a polarized capacitor having two plates arranged on opposite sides of the key bit 20 in the module recess, the plates are used in place of the aforesaid coils 57 and 58. The variation in capacitance of the capacitor reveals the presence or absence of the key in the module.

The light-emitting diode 4 and the members of the key detecting means 5 for each module 3 are suitably fixed in the module recess. The modules include four or six electric terminals, depending on the embodiment of the key detecting means 5, in the form of pins 33 extending from the bottom of the module and running through the common back face 12 of the panel 1 recesses. The pins are connected to wiring of the panel electronic managing system.

Figure 3:
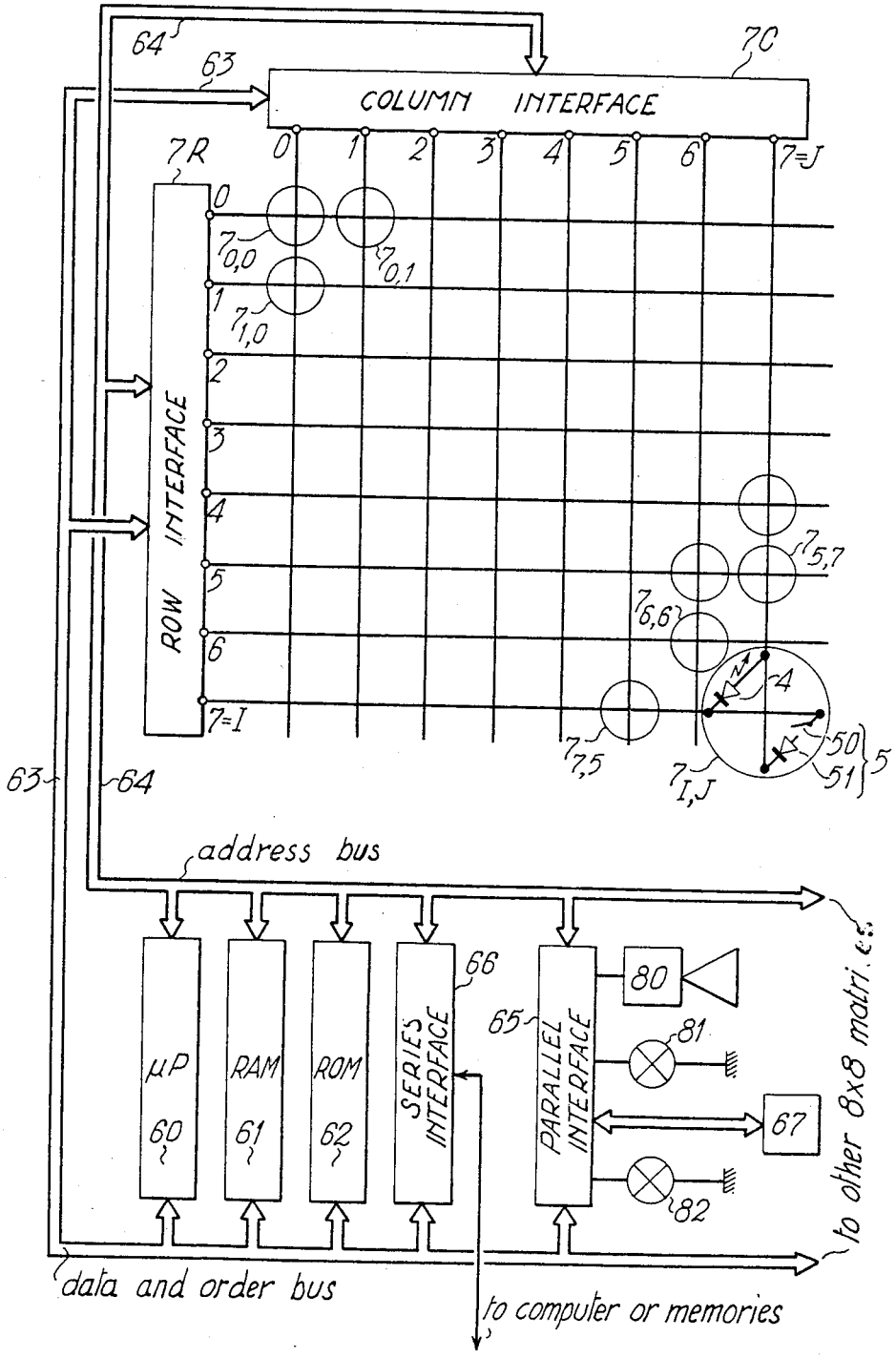
FIG. 3 is a schematic block diagram of the electronic system peculiar to the assisted management of the panel.

The managing system, schematically illustrated in FIG. 3, is preferably integrated into a console in front of the panel. Management of the keys on the panel is organized around a microprocessor 60 that is connected to a RAM or PRAM data random access memory 61 and a ROM or PROM order reed only memory 62 via a data and order bidirectional bus 63 and an address bidirectional bus 64. The buses 63 and 64 are connected to, a parallel interface 65 comprising a parallel-to-parallel digital converter, a series interface 66 comprising a parallel-to-series digital converter, and plural parallel interface pairs 7R and 7C, one of which is illustrated in FIG. 3.

The interface 65 serves a 16-pushbutton keyboard 67, as well as several indicator means 80, 81 and 82 that are set out on the abovementioned console. The interface 66 may also connect the microprocessor 60 to other memories similar to memories 61 and 62 to adapt the capacity of all the memories to the number of keys to be handled, and/or to a computer that derives statistical information on key management or programs each round.

Each parallel interface 7R, 7C comprises eight elementary terminals numbered from 0 to 7 from top to bottom and from left to right in FIG. 3. The interfaces 7R and 7C address the rows and columns of a submatrix of $8\times8=64$ cross-over points $7_{0,0}$ to $7_{I,J}$ that are respectively associated with 64 modules. Each cross-over point $7_{i,j}$, where integer i varies between 0 and $I=7$ and integer j varies between 0 and $J=7$, is served by terminal i of the interface 7R of the row having rank i in the $8\times i$ sub-matrix and by terminal j of the interface 7C having column of rank j in the $8\times8$ sub-matrix. At each cross-over point $7_{i,j}$, the light-emitting diode 4 and the member 50–51, 56 or 58 of the key detecting means 5 associated with the respective module are oppositely poled between the respective terminals i and j.

By way of an example, as illustrated in detail in FIG. 3 at the cross-over point $7_{I,J}$, the diode 4 is forward-biased from the terminal $J=7$ to the terminal $I=7$ whereas the contact 50–51, or the phototransistor 56, or the receiving coil 58, is forward-biased from the terminal $I=7$ to the terminal $J=7$. Only the light-emitting diode 4 in the respective module associated with the cross-over point $7_{I,J}$ is energized to indicate that the respective key is to be withdrawn or introduced when the terminal J is at the high binary state "1" and the other terminals 1 to J-1 of column interface 7C are at the low binary state "0" and when the terminal I is at the low state "0" and the other terminals 1 to I-1 of row interface 7R are at high state "1"; none of the polarized contacts 50''51 is rendered operative regardless of whether the respective key is absent or present in the module. Conversely, when the row interface 7R applies high state "1" to the terminal I and the low state "0" to the other terminals 1 to I-1, the contact 50–51 at the cross-over point $7_{I,J}$ is turned on when the key is present in the module and causes connection of reeds 52 and 53 to set the terminal J to state "0" that is detected to check the presence of the key in the module; in the latter case, all the light-emitting diodes 4 are switched off and the contacts 50–51 at the other connection points induce no current even in the presence of the respective keys. Thus, the light-emitting diodes 4 in the $8\times8$ matrix can individually be energized, and the states of the contacts 50–51 or, more generally, of the key detecting means 5 of the matrix can be read individually. The individual excitations and readings are selected by addressing from the microprocessor 60 via the bus 64, and the read state of a contact 50–51 is retransmitted to the microprocessor 60 via the bus 63.

With regard to the embodiment of the panel 1 illustrated in FIG. 1, the managing system comprises 16 pairs of interfaces 7R, 7C for managing $16\times64=1024$ cross-over points split into sixteen $8\times8$ sub-matrices; twenty-four cross-over points go unused for a panel with one thousand modules. Every time a cross-over point is selected, the microprocessor 60 derives the address of the cross-over points together with the addresses of the two respective interfaces 7R and 7C and a specific bit indicating that the diode 4 or the key detecting means 5 at the cross-over point must be energized to apply the appropriate bias.

By distributing the cross-over points into $8\times8$ sub-matrices, it is possible to limit the number of output conductor leads from the panel to $16\times16=256$ instead of $2\times1024=2048$ for the case where the cross-over points are addressed individually and directly.

A description is now given of how the managing system for a panel embodying this invention is used to pick predetermined combinations of keys intended for collectors entrusted with opening coin-box access compartments locked with a key in item or service vending machines. Each collector using the keys on the panel makes up a bunch of keys in a predetermined order; the coin-box compartments are successively opened during the round in the predetermined order or the reverse order thereof.

The day before the rounds for recovering the coin-boxes, the operator uses a conventional printer to list the numbers of the vending machines that must be visited during a particular round and the order in which the vending machines are to be visited as set forth in Table I below.

TABLE I

| Day | Round | Order No. | Machine and key No. |
|---|---|---|---|
| 265 | 01 | 01 | 0057 |
| | | 02 | 0832 |
| | | 03 | 0183 |
| | 02 | 01 | 0310 |
| | | 02 | 0628 |
| | | 03 | 0022 |

The number of the vending machine and the respective key for the coin-box compartment are borne on the front face of the respective module 3 in the panel 1, as shown in FIG. 1. The vending machine number is typically engraved on an opaque plate placed in front of the respective light-emitting diode 4, thereby facilitating the number reading by the collector responsible for the round and the operator ascribed to the console.

By using the keyboard 67, the operator then enters the suitably coded data from Table I above these data are stored in memory 61. For a round, the microprocessor 60 delivers the addresses of the interfaces 7R and 7C and the address of the number of the respective cross-over point in the sub-matrix corresponding to each key number in response to successive readings of the key numbers in the predetermined order.

On the day of the rounds, the operator checks that the keys are in the panel by means of a program previously stored in the memory 62 and triggered in response to activation of keyboard 67. The program referred to as a key presence test program lasts approximately 500 ms. It is composed of a subprogram to test for the presence of the keys in the modules corresponding to an $8\times8$ sub-matrix and an interface pair 7R, 7C, the subprogram being repeated as many times as there are $8\times8$ sub-matrices. The subprogram includes the following steps for each assemblage of $8\times8$ sub-matrix and interface pair 7R, 7C:

- the microprocessor addresses the interface pair 7R, 7C via the bus 64;
- the terminals I=0, 1, 2, 3, 4, 5, 6, and 7 of the interface 7R are set to 10000000 respectively.
- the states of the terminals J=0–7 of the interface 7C are read and should all be equal to "0" if the keys corresponding to the first line of cross-over points $7_{0,0}$ to $7_{0,7}$ are in their respective modules;
- the terminals I=0, 1, 2, 3, 4, 5, 6, and 7 of the interface 7R are set to 01000000 respectively.
- the states of the terminals J=0–7 of the interface 7C are read; and
- the last two steps are basically repeated for each of the remaining rows in the sub-matrix.

When the interface 7C detects a terminal having a signal in an abnormal state "1", which indicates the absence of the respective key, the interface 7C delivers an encoded word to the microprocessor 60. The microprocessor 60 checks to determine whether the key in question should have been absent, which is the case for the 24 unused cross-over points in a one-thousand key panel for a cross-over point for which the respective key has been withdrawn normally in the course of making up a bunch of keys for a round, as will be seen later. Should the key normally have been present, the microprocessor 60 delivers an alarm signal to the interface 65; the alarm signal is converted, for example, into an audiofrequence alarm by a loudspeaker 80 included in the console, and/or a bias reversing signal supplied to interfaces 7R and RC; the bias to activate the light-emitting diode 4 in the missing-key module.

On the day of the rounds, using the keyboard 67, the operator enters the number 1 for the first round and a suitable operation code. The microprocessor 60 reads the key numbers of the first round in the memory 61 and delivers successively the addresses of the interfaces 7R and 7C and the addresses of the respective cross-over points. For each key to be withdrawn, the program is as follows:

- the microprocessor selects the two respective interfaces 7R and 7C;
- the terminal of the interface 7C serving the respective cross-over point is set to "1" while the other terminals of the interface 7C are set to "0";
- the terminal on the interface 7R serving the respective cross-over point is set to "0" while the other terminals of the interface 7R are set to "1";
- the respective light-emitting diode 4 is energized;
- the collector for the round must withdraw the respective key during a predetermined period lasting approximately 500 ms for example;
- the above diode 4 then goes out automatically due to bias inversion after withdrawal of the respective key, and the abovementioned key presence test program is triggered to check that the collector has not taken any keys other than those already withdrawn for his round: the check is performed by the microprocessor 60 which compares a presence or absence indicating bit in the memory 61 with a bit read in the respective column interface for each location;
- after the test program has been executed, the light-emitting diode 4 corresponding to the next respective key to be withdrawn is automatically addressed and energized by the same procedure;
- after all the keys of the first round have been withdrawn, the microprocessor 60 apprises the operator accordingly by illuminating an indicator lamp 81 on the console, via the interface 65. The keys of other rounds for other collectors are then withdrawn as before. When the collectors return after having taken the coin-boxes from the vending machines, each collector puts the keys of his round back on the panel in the same order or the reverse order chosen by the operator; the keys are replaced by following a program similar to that for withdrawal as described above.

Should several key panels prove necessary, the microprocessor 60 ascribes an address to each panel every time a panel is used for withdrawal or insertion of one of the keys thereof, a respective indicator lamp 82 is activated on the console so as to orientate the operator to the panel in question.

While the invention has been illustrated and described in conjunction with preferred embodiments thereof, it is to be understood that numerous changes and modifications may be resorted to without departing from the spirit and the scope of the appended claims. Essential components for the managing system or the panel taken separately come within the scope of the invention; this is particularly so for the panel 1 itself, and object module or receptable 3, or one of the embodiments of the detectors 5 for the presence or absence of an object.

What we claim is:

1. A system for managing an object panel on which an object has a respective location designated by an address and associated with a display means, said system comprising means for storing predetermined selectively changed combinations of location addresses, means for successively reading said stored combinations, means for successively energizing said display means at locations designated by the read addresses of the same combination as one of the stored combinations to indicate that the objects are to be withdrawn or inserted at said locations, and means for detecting objects to check the withdrawal or insertion of said withdrawn or inserted objects in said panel, said display means at a location designated by a read address of a combination being energized and the display means at the location designated by the address previously read in said combination being deenergized in response to the detection of the withdrawal or insertion of the object at said location designated by said previous address.

2. A system as claimed in claim 1 comprising means for checking a normal presence or absence of all the objects in the panel after withdrawal or insertion of each object for which the respective display means have been energized.

3. A system as claimed in claim 2 comprising alarm means for indicating an abnormal withdrawal or insertion of an object other than the objects normally withdrawn or inserted at the locations having addresses that have been read.

4. A system as claimed in claim 1 comprising means for individually triggering reading of each stored address combination to successively signal that objects should be withdrawn or inserted at locations designated by the addresses of said combination.

5. The system claimed in claim 1 wherein each display means displays said address designating said location of said respective object.

6. The system claimed in claim 1 wherein said location of each object in the panel includes a removable receptacle having an opening with an outline substantially identical to a predetermined portion of said object for enabling said predetermined portion of the object to fit into the opening.

7. The system claimed in claim 6 wherein said object receptacle contains said display means and said object detecting means associated with said object.

8. The system claimed in claim 1 wherein said display means and said object detecting means associated with each object are oppositely poled.

9. The system claimed in claim 8 wherein each location includes an individual display means and each object detecting means forms a cross-over point of a matrix, said display means being individually energized by a predetermined bias and said object detecting means being individually energized by a reverse bias with regard to said predetermined bias.

10. An object receiving panel for a system for aiding successive withdrawals of objects according to predetermined combinations and successive insertions of said withdrawn objects according to said predetermined combinations, the objects having different shapes, said panel comprising: recesses for respectively receiving said objects, each recess having an opening with an outline substantially identical to a predetermined portion of a respective object for enabling the predetermined portion of the object to fit therein, the openings of different recesses having different shapes to accommodate the objects having different shapes, each recess being associated with and in close proximity with each recess for signalling to the system whether said predetermined portion of said respective object is present or absent in said recess opening.

11. The panel of claim 10 wherein said display means of a recess, when energized, illuminates a number designating said recess and said respective object.

12. The panel of claim 10 wherein said recesses are removable receptacles for said objects.

13. The panel of claim 10 wherein each object detecting means comprises a polarized contact having two reeds, said predetermined portion of said respective object sliding against one of said reeds as the object is being inserted into said recess opening so as to close said contact.

14. The panel of claim 13 wherein said polarized contact and said display means in each recess are oppositely poled.

15. The panel of claim 10 wherein each object detecting means comprises a photoemissive member and a photoreceptive member arranged on opposite sides of said predetermined portion of said respective object in said recess.

16. The panel of claim 15 wherein said photoemissive members emit in the infrared waveband.

17. The panel of claim 15 wherein said photoreceptive member and said display means in each recess are oppositely poled.

18. The panel of claim 10 further comprising a single photoemissive member illuminating a side of said predetermined portions of said objects in said recesses, each object detecting means comprising a photoreceptive member arranged on another side of said predetermined portion of said object in said recess.

19. The panel of claim 18 wherein said photoemissive member emits in the infrared waveband.

20. The panel of claim 18 wherein said display means and said photoreceptive means in each recess are oppositely poled.

21. The panel of claim 10 wherein each object detecting means comprises an emitting coil and a receiving coil on opposite sides of said predetermined portion of said respective object in said recess.

22. The panel of claim 21 wherein said display means and said receiving coil in each recess are oppositely poled.

23. The panel of claim 10 wherein each object detecting means comprises a polarized capacitor having first and second plates on opposite sides of said predetermined portion of said respective object in said recess.

24. The panel of claim 23 wherein said display means and said capacitor in each recess are oppositely poled.

25. Apparatus for detecting if objects are removed from and/or inserted into plural holding compartments for the objects in correct sequence comprising an object detector in each compartment for setting an indicator so it has first and second states respectively indicative of the presence and absence of the object in the compartment, programmable memory means for storing signals representing the sequence that the objects are supposed to be removed from and/or inserted into the plural compartments, input means for (a) supplying signals to the programmable memory means for changing the signals stored therein and representing the sequence that the objects are supposed to be removed from and/or inserted into the plural compartments and (b) reading out the stored signals representing the objects in the sequence that the objects are supposed to be removed from and/or inserted into the plural compartments, indicator means responsive to the readout stored signals for indicating to personnel the sequence in which the objects are to be removed from and/or inserted into the plural compartments, and means responsive to the set indicators and the readout stored signals for signalling whether the objects are removed from or inserted into the compartments in the sequence that the objects are supposed to be removed from or inserted into the compartments.

26. The apparatus of claim 25 wherein the indicating means includes a light source at the location of each compartment, the light sources being responsive to the readout stored signals so that the light sources are activated in the sequence that the objects are supposed to be removed from or inserted into the compartments.

27. The apparatus of claim 26 further including means responsive to a change in the set state for the compartment associated with the activated light source for deactivating the light source so that the light source is extinguished in response to the object being removed from the compartment and in response to the object being inserted into the compartment.

28. The apparatus of claim 25 further including fixed memory means for storing signals indicative of which compartments are supposed to have objects therein at a time when no objects are supposed to be removed from the compartments, the input means supplying a signal to the fixed memory for reading out from the fixed memory the signals indicative of which compartments are supposed to have objects therein at a time when no objects are supposed to be removed from the compartments, and means responsive to the signals read out of the fixed memory and the set indicators for signalling whether all of the compartments that are supposed to have objects therein do have the objects therein.

* * * * *